US010422039B2

(12) United States Patent
Chin et al.

(10) Patent No.: US 10,422,039 B2
(45) Date of Patent: Sep. 24, 2019

(54) STREAM FLOW SPARGER FOR ELECTROLESS NICKEL PLATING

(71) Applicant: SEAGATE TECHNOLOGY LLC, Cupertino, CA (US)

(72) Inventors: Boon Kuan Chin, Penang (MY); James Tephon Anak Goel, Johor (MY)

(73) Assignee: SEAGATE TECHNOLOGY LLC, Cupertino, CA (US)

( * ) Notice: Subject to any disclaimer, the term of this patent is extended or adjusted under 35 U.S.C. 154(b) by 0 days.

(21) Appl. No.: 15/161,002

(22) Filed: May 20, 2016

(65) Prior Publication Data

US 2017/0335463 A1 Nov. 23, 2017

(51) Int. Cl.

| | |
|---|---|
| ***C23C 18/32*** | (2006.01) |
| ***B05C 3/04*** | (2006.01) |
| ***C23C 18/16*** | (2006.01) |

(52) U.S. Cl.

CPC ..... *C23C 18/32* (2013.01); *B05C 3/04* (2013.01); *C23C 18/1617* (2013.01); *C23C 18/1619* (2013.01); *C23C 18/1628* (2013.01); *C23C 18/1669* (2013.01)

(58) Field of Classification Search

CPC ..... B05C 3/04; C23C 18/1601–1632
USPC ..... 118/429
See application file for complete search history.

(56) References Cited

U.S. PATENT DOCUMENTS

| | | | | |
|---|---|---|---|---|
| 3,207,128 | A * | 9/1965 | Leavitt, Jr. | B23K 3/0653 118/110 |
| 4,622,917 | A * | 11/1986 | Schramm | C23C 18/1616 118/315 |
| 5,071,488 | A * | 12/1991 | Takayama | B08B 3/04 134/34 |
| 6,732,749 | B2 * | 5/2004 | Myland | B08B 3/102 134/186 |
| 2004/0018675 | A1 | 1/2004 | Test et al. | |
| 2012/0247223 | A1 | 10/2012 | Sawchuk et al. | |

* cited by examiner

*Primary Examiner* — Dah-Wei D. Yuan
*Assistant Examiner* — Stephen A Kitt
(74) *Attorney, Agent, or Firm* — Holland & Hart LLP

(57) ABSTRACT

Systems and methods for nickel plating include providing a tank that retains a plating bath into which a substrate is submerged, and creating a horizontal flow of processing solution in the plating bath to assist in carrying contaminants out of the plating bath. A sparger box may be positioned in the tank to deliver the processing solution into the plating bath in a horizontal direction. The processing solution, which carries the contaminants, may exit the plating bath through a plate member that includes a plurality of orifices and is also positioned in the tank. The orifices may have a variable opening size to help control outflow of the processing solution.

15 Claims, 8 Drawing Sheets

STREAM FLOW SPARGER FOR ELECTROLESS NICKEL PLATING

SUMMARY

According to at least one embodiment, a nickel plating system and related methods of nickel plating are disclosed. The nickel plating system may provide for horizontal or other non-vertical flow of processing fluid in a plating bath to assist in removing contaminants from the plating bath.

In some embodiments, a nickel plating system includes a tank, a flow device, and a filter device. The tank is configured to hold a volume of processing solution and a plurality of contaminants, the tank configured to receive at least one substrate to receive nickel plating. The flow device is operable to provide horizontal flow of the processing solution within the tank. The horizontal flow of processing solution carries at least some of the plurality of contaminants out of the tank. The filter device is arranged in flow communication with an outlet from the tank and configured to remove the contaminants from the processing solution.

The flow device may include a laminar sparger box arranged vertically at one end of the tank. The laminar sparger box may include an inlet opening configured to receive a flow of the processing solution, and a plurality of outlet openings oriented facing horizontally in the tank. The flow device may include a plate assembly oriented vertically in the tank and positioned at an opposite end of the tank from the sparger box, wherein the plate assembly includes a plurality of orifices. The plate assembly may include an adjustable plate and a fixed plate. The adjustable plate may be movable relative to the fixed plate to adjust flow rate through the plurality of orifices. The plurality of orifices may be adjustable-sized orifices. The plating system may further include a weir mounted to a top end of the plate assembly, the weir providing even flow of the processing solution over a top end of the plate assembly.

Another electroless nickel plating system is disclosed, comprising a tank and a flow device. The tank is configured to hold a volume of processing solution and a plurality of contaminant. The tank is also configured to receive at least one substrate to receive nickel plating. The flow device includes a laminar sparger box positioned at a first end of the tank. The sparger box is configured to deliver a flow of processing solution horizontally into the tank, wherein the plurality of contaminants are carried by the flow of processing solution. The flow device also includes a plate assembly positioned at a second end of the tank. The plate assembly comprises a plurality of orifices receptive of the flow of processing solution and the plurality of contaminants.

The plurality of orifices may be arranged facing horizontally in the tank. The sparger box may be oriented vertically at one end of the tank and the plate assembly may be oriented vertically at an opposite end of the sparger box. The system may also include at least one filtering member arranged in flow communication with an outlet of the tank and operable to remove contaminants from the processing solution removed from the tank. The plate member may include a first plate having the plurality of orifices formed therein, and a second plate that is movable relative to the first plate to control a functional opening size of the plurality of orifices. The system may include a weir positioned mounted to the plate member at a location vertically above the plurality of orifices. The system may further include a carriage operable to move the at least one substrate into and out of the volume of processing fluid.

A method for nickel plating is disclosed. The method includes providing a tank configured to hold a volume of processing solution and contaminants collected during nickel plating of at least one article, and a flow device positioned in the tank. The method further includes delivering a flow of the processing fluid from the flow device horizontally into the tank to create a horizontal flow, the contaminants being carried by the horizontal flow, and positioning one or more articles in the tank and exposing the one or more articles to the horizontal flow.

The flow device may include a laminar sparger box, and the method includes submerging the laminar sparger box in the processing solution held in the tank. The flow device may include a plate member, wherein the plate member comprises a plurality of inlet openings, the method further comprises adjusting a size of the inlet openings to control rate of flow of the processing solution out of the tank. The plate member may include a first plate having the plurality of inlet openings, and a second plate, and the method comprises moving the second plate relative to the first plate to control rate of flow of the processing solution from the tank. The method may include providing a weir positioned in the tank, and passing a portion of the processing solution and the contaminants over the weir. The at least one article may include a non-magnetic substrate of a magnetic disc.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
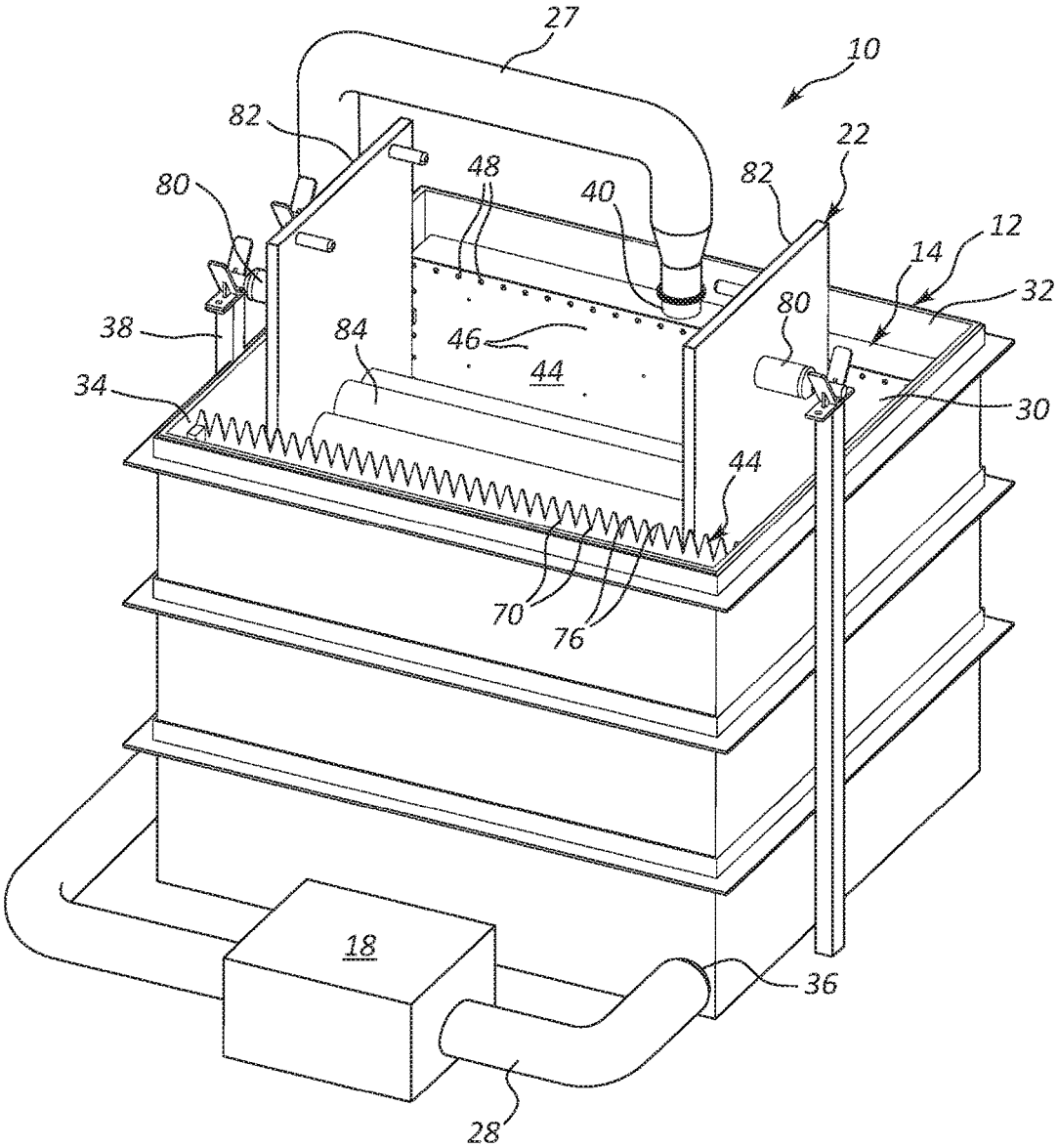
FIG. 1 is a perspective view of a plating system in accordance with the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The systems and methods described here in relate generally to plating systems and methods. More particularly, the systems and methods described herein relate to nickel plating such as electroless nickel plating. One application for electroless nickel plating is for nickel coating substrates as part of manufacturing magnetic recording media.

Nickel (Ni) plating, particularly electroless nickel plating or deposits, is used in a variety of industries such as electronics, oil and gas, aerospace, machining, automobile, and magnetic recording media industries. In magnetic recording media applications, a magnetic disk comprising a non-magnetic substrate such as aluminum or an aluminum alloy may be coated with an amorphous nickel deposit.

Magnetic disk drives are normally operated using a contact start-stop (CSS) method. In the CSS method, the head begins to slide against the surface of the magnetic disk as the disk begins to rotate and, upon reaching a predetermine rotational speed, the head floats in the air at a fixed distance above the surface of the disk. The distance that the head floats above the surface of the disk is called the flying height. The head floats above the surface of the disk due to dynamic pressure effects caused by airflow generated between the sliding surface of the head and the magnetic disk. During reading and/or recording operations of the disk drive, the head is maintained at a controlled distance from the surface of the magnetic disk, supported on a bearing of air as the disk rotates. Upon terminating operation of the disk drive, the rotational speed of the magnetic disk is decreased such that the head begins to slide against the surface of the disk until it eventually stops, in contact with and pressing against the disk. Thus, each time the head and disk assembly is driven, the sliding surface of the head repeats this cyclic operation consisting of stopping, sliding against the surface of the disk, floating in the air, sliding against the surface of the disk, and stopping.

In order to achieve high aerial density, it is considered necessary to minimize the flying height of the head above its associated recording surface. Thus, conventional textured substrates must be provided with an extremely smooth and defect-free surface in order to achieve the requisite low-flying height for high aerial recording density. The absence of defects on the media such as pits and sub-bumps is especially important, since pits and sub-bumps adversely influence magnetic recording.

It is recognized, however, that conventional electroless metal plating, such as electroless nickel plating, of a substrate is not free from a defect known as plating inclusion. Plating inclusion results from contaminants or impurities that are present in the plating bath as a result of the mechanical friction and interaction between the substrates and the rack mechanisms and spindles to which they are mounted. In the conventional electroless nickel plating process, the chemicals are vertically pushed upwards in the plating bath. This vertical flow of chemicals in the plating bath is not effective at moving the contaminants to the surface of the plating bath and out from the plating bath. More often than not, the contaminants will eventually end up being plated onto the surface of the substrate (e.g., disk) that is immersed in the plating bath. The contaminants result in pits and sub-bumps at the backend process, which results in an inferior product.

One aspect of the present disclosure relates to providing a horizontal flow of chemicals in the plating bath. The chemicals may be referred to as processing fluid, processing solution, chemical solution, chemical bath, or the like. The horizontal flow through the plating bath may be provided in a number of ways. One way is facilitated with a laminar sparger (LS) box that is oriented vertically within a plating tank. The sparger box includes a plurality of holes positioned along a surface of the sparger box that faces horizontally towards an opposite end of the tank. The processing solution is directed horizontally out of the holes of the sparger box and into the plating bath held in the tank. A separate outlet plate is positioned at an opposite end of the tank and is configured to receive the horizontal flow. The outlet plate also has a surface arranged vertically in the tank. This surface includes a plurality of orifices that face horizontally into the plating bath in a direction facing the sparger box. The orifices provide a flow path for the horizontal flow of processing fluid to exit the plating bath. An opposite side of the outlet plate is exposed to atmospheric pressure conditions. The flow of processing fluid through the orifices is then directed to an outlet of the tank. The processing fluid collects, carries and/or transports the contaminant particles held in the tank as the processing fluid travels through the plating bath. The flow of processing fluid, along with the contaminants that it carries, is directed through the outlet plate and out of the tank where the contaminants are later filtered out of the processing fluid.

The outlet plate with its plurality of orifices may include features that help control outflow of the processing fluid and contaminants from the plating bath. For example, at least some of the orifices may be may adjustable sized orifices. The size of the orifices may be changed by moving a pair plates relative to each other, wherein each of the plates includes a plurality of openings that at least partially overlap with each other. Moving one plate relative to the other plate may change the alignment of the apertures thereby controlling the effective opening size of the orifices. In some examples, the plates may be moved relative to each other in order to completely close the orifices, such as during filling of the tank with processing fluid to create the plating bath. After the tank is filled or at least filled to a certain level, the plates may be moved relative to each other to at least partially open the orifices thereby creating a desired fluid flow out of the plating bath. In some embodiments, each individual orifice may be individually adjusted in size. In other embodiments, the size of groups of orifices or all of the orifices may be adjusted concurrently. Some of the orifices may have different sizes than others, such as larger orifices near the top of the tank so as to account for different flow rates through the orifices resulting from fluid pressures inherent at different depths within the plating bath.

The system may also include a weir that controls flow of fluid across the top surface of the plating bath. The weir may be mounted at a top end of the outlet plate that carries the outlet orifices. The weir may define a plurality of flow channels. The amount of processing fluid that travels over the weir (e.g., through the flow channels) may depend on a variety of variables such as, for example, the size of the orifices in the plate, the flow rate of processing fluid from the sparger box into the plating bath, the depth of the processing fluid in the tank, and whether or not the substrates to be plated (e.g., non-magnetic aluminum or aluminum alloy substrates) are immersed in the plating bath.

FIG. 1 illustrates an example plating system 10 in accordance with the present disclosure. The plating system 10 includes a tank 12, a sparger box 14, a plate assembly 16, a filter 18, a weir 20, and a carriage or rack 22. The tank 12 may be referred to as an electroless nickel plating tank. The filter 18 is connected in flow communication with the tank 12 via inlet and outlet lines 27, 28. Although the filter 18 is shown as a separate, independent structure from the tank 12, other embodiments may include the filter 18 integrated into or mounted directly to a portion of tank 12. In some embodiments, the filter 18 may be positioned internal tank 12.

Figure 2:
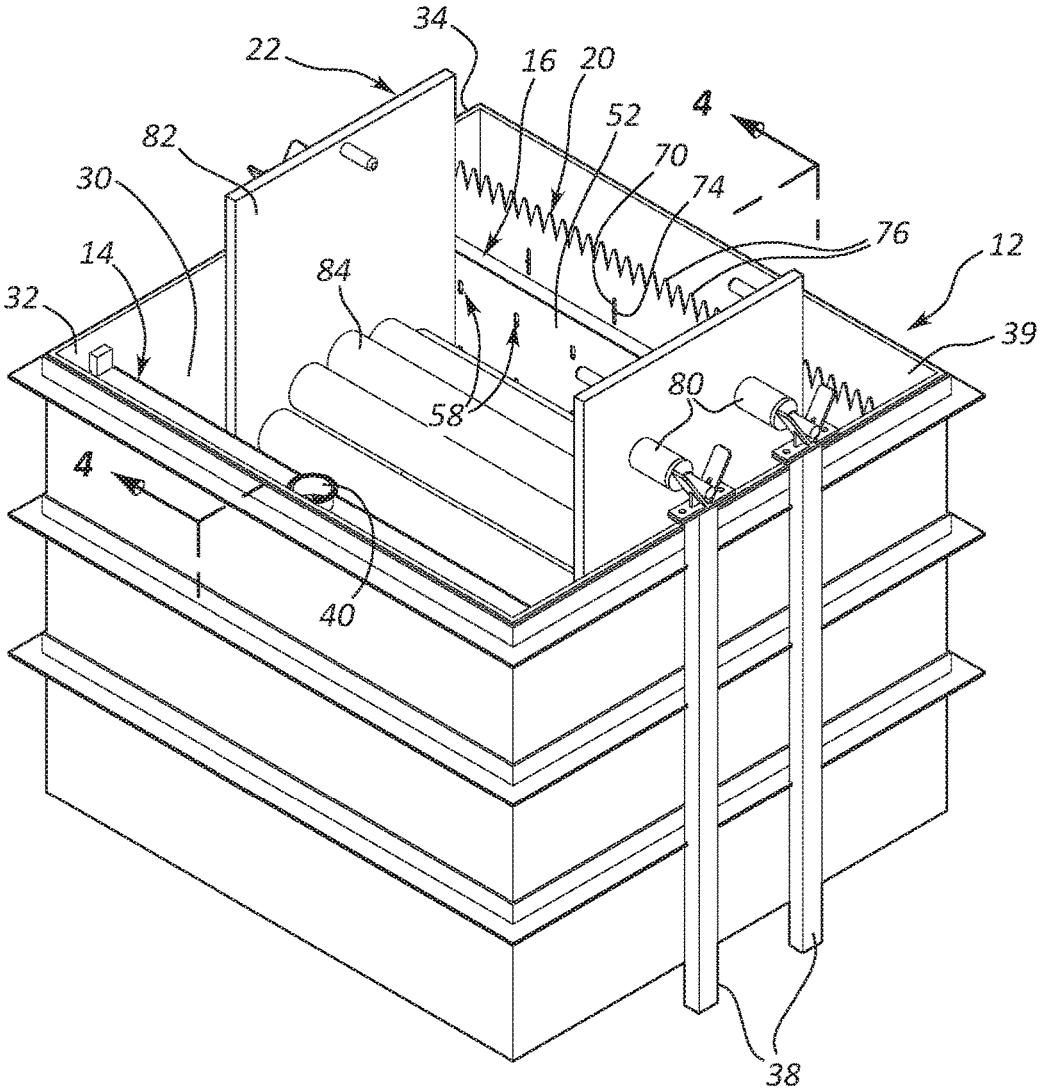
FIG. 2 is another perspective view of a portion of the plating system shown in FIG. 1.
Figure 3:
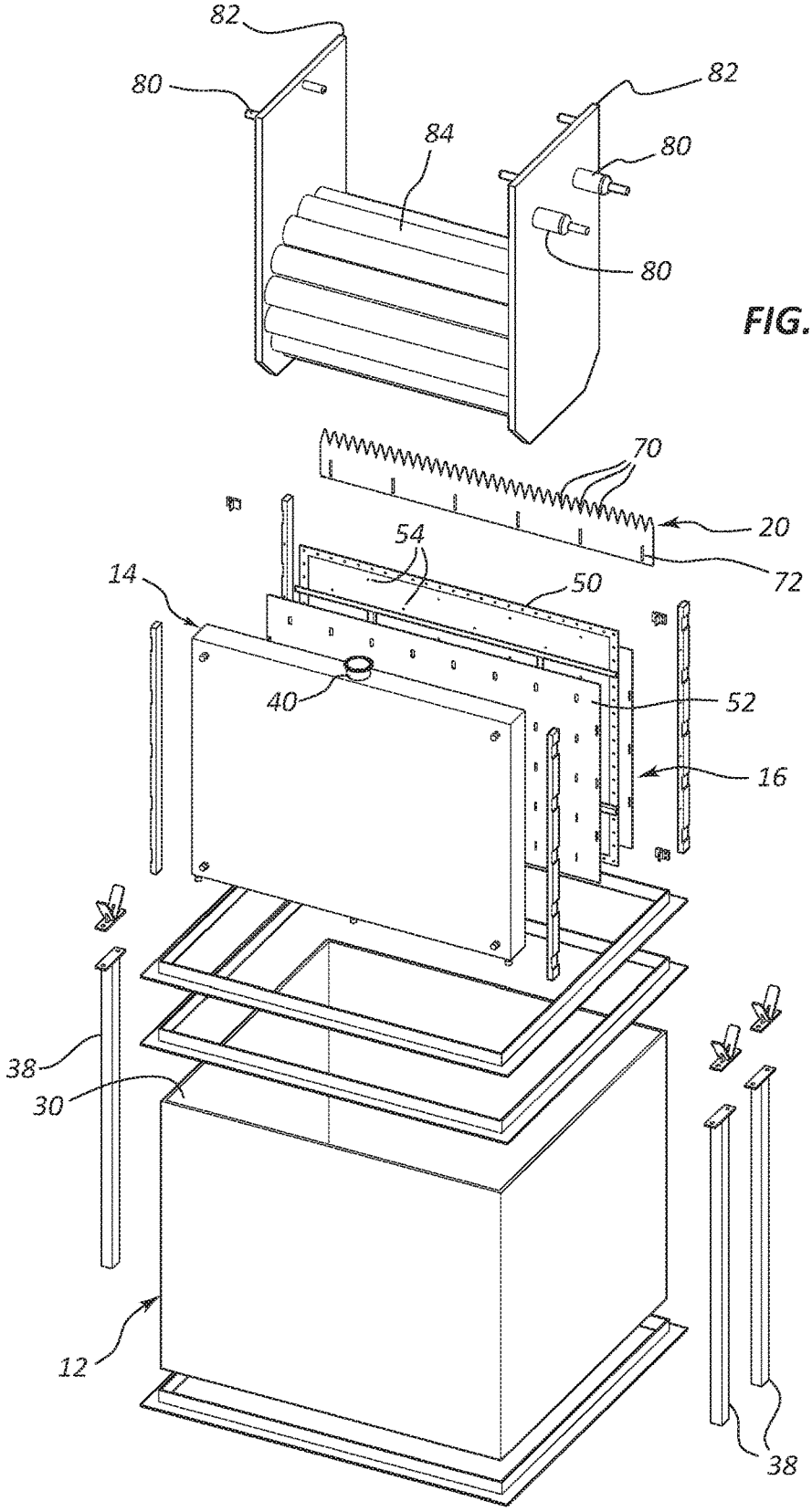
FIG. 3 is an exploded perspective view of a portion of the plating system shown in FIG. 2.
Figure 4:
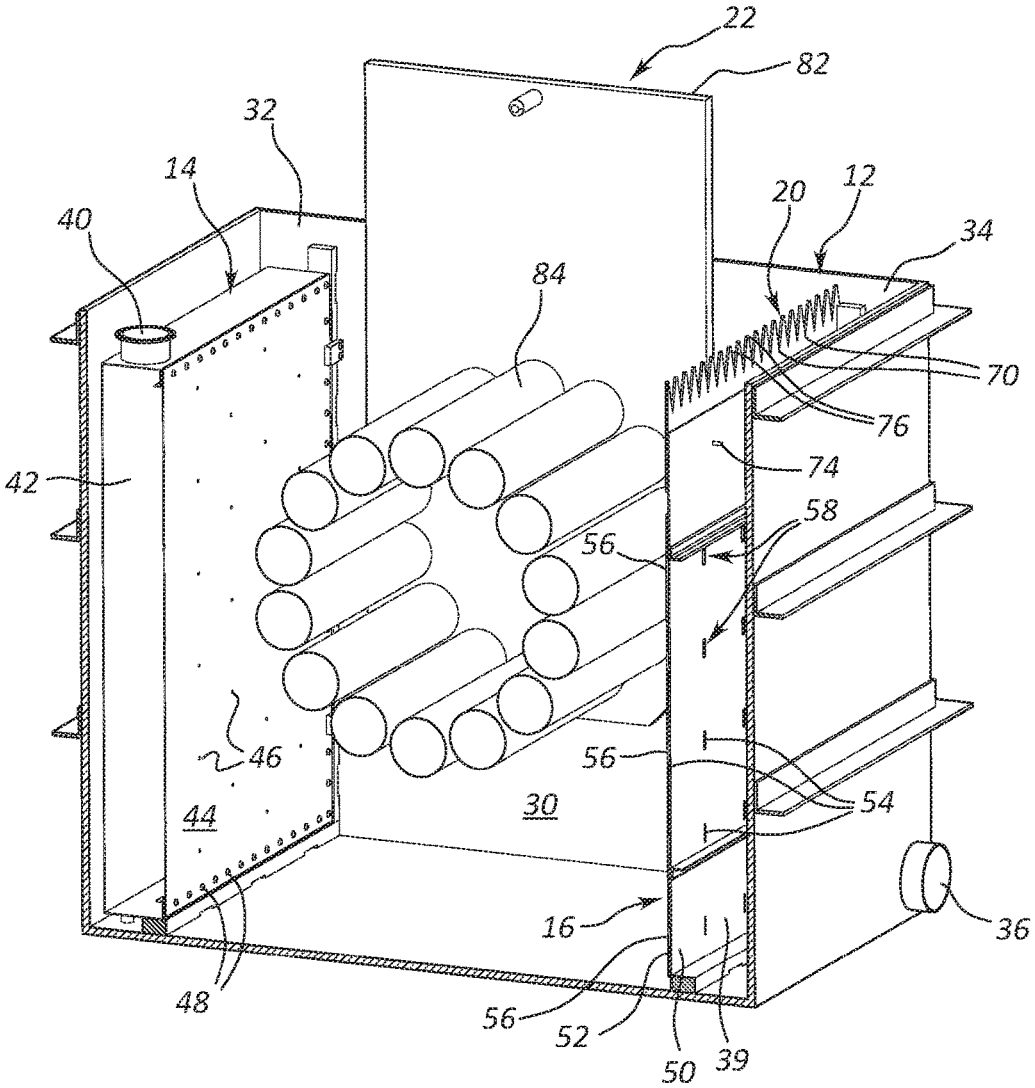
FIG. 4 is a perspective cross-sectional view of the portion of a plating system shown in FIG. 2 taken along cross-section indicators 4-4.
Figure 5:
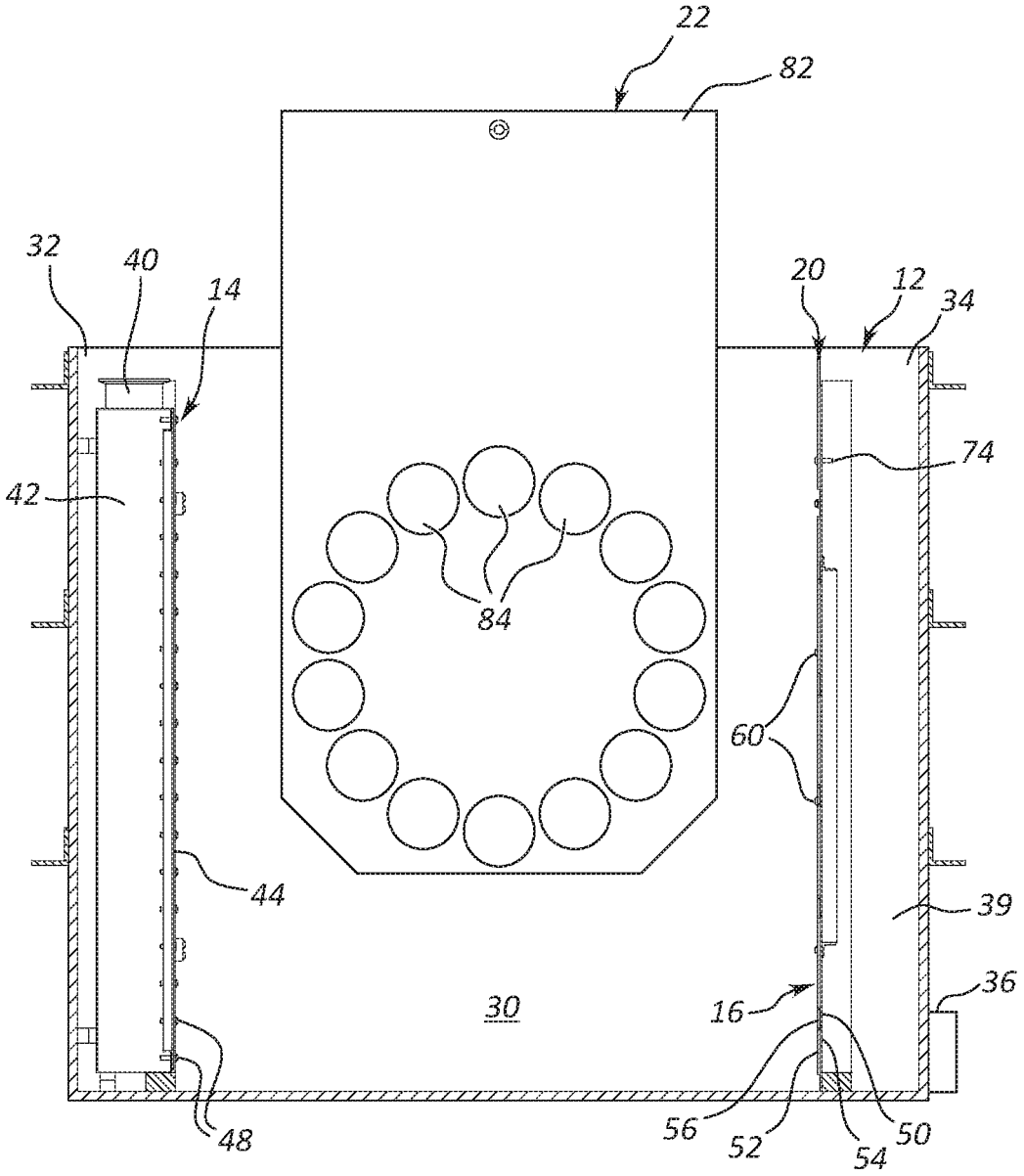
FIG. 5 is a plan view of the cross-section shown in FIG. 4.

FIGS. 2-7 illustrate only portions of the plating system 10 for purposes of more clearly illustrating operation of the plating system 10. FIG. 2 is a perspective view of the plating system 10 without the filter 18 and inlet and outlet lines 27, 28. FIG. 3 is an exploded view of the plating system features shown in FIG. 2. FIGS. 4-7 illustrate cross-sectional views of the plating system 10 portions shown in FIG. 2 taken along cross-section indicators 4-4.

Referring to FIGS. 1 and 2, the tank 12 includes an interior 30, first and second ends 32, 34, an outlet opening 36, and carriage supports 38. The sparger box 14 and plate assembly 16 are positioned inside the tank interior 30. The sparger box 14 may be positioned at the first end 32. The plate assembly 16 may be positioned at an opposite end of the tank 12 such as at the second end 34. The plate assembly 16 may be spaced away from the second end 34 to provide a rear chamber 39 (see FIGS. 2 and 4). The weir 20 may be mounted to the plate assembly 16, such as along a top end of the plate assembly 16. The carriage or rack 22 may be inserted into the tank interior 30 at a location between the sparger box 14 and the plate assembly 16.

The sparger box 14 may include an inlet opening 40, a chamber 42 (see FIG. 4), a front surface 44 with outlet openings 46 (see FIG. 4), and a plurality of fasteners 48 that secure the front surface 44 (or a plate that defines the front surface 44) to the remaining portions of the sparger box 14. The front surface 44 with outlet openings 46 may be replaceable so as to provide different arrangements, sizes, and numbers of outlet openings 46, any of which may influence the flow characteristics of the processing fluid through the tank interior 30. In other embodiments, the front surface 44 is formed integral with the remaining portions of the sparger box 14 (e.g., no fasteners 48 are required and/or the front surface 44 with outlet openings 46 is not replacable relative to the rest of the sparger box 14).

Referring to FIG. 3, the plate assembly 16 includes first and second plates 50, 52. The first plate 50 includes a plurality of first openings 54. The second plate 52 includes a plurality of second openings 56. When the first and second plates 50, 52 are connected to each other, the openings 54, 56 may be generally aligned with each other to define a plurality of orifices 58. At least some of the orifices 58 may have an adjustable size to assist in controlling the amount of processing fluid that passes through the orifices 58. The size or effective opening of the adjustable orifices 58 may be varied by moving the first and second plates 50, 52 relative to each other. For example, the first and second plates 50, 52 may be adjusted relative to each other such that the openings 54, 56 are out of alignment thereby closing the adjustable orifices 58. In another relative positioning of the first and second plates 50, 52, the openings 54, 56 have a maximum amount of overlap thereby providing a maximum opening size for the adjustable orifices 58.

The arrangement for the plate assembly 16 shown in the figures provides for concurrent adjustment of all of the adjustable orifices 58 by moving the first and second plates 50, 52 relative to each other. In some embodiments, the first plate 50 may maintain a fixed location in the tank interior 30, while the second plate 52 is moved relative to the first plate 50 (e.g., in a vertical or horizontal direction). In other embodiments, both the first and second plates 50, 52 may be moveable relative to each other and/or to the tank 12. In still further embodiments, each of the adjustable orifices 58 may be individually adjusted in size to control the rate of fluid flow through that particular orifice. In other embodiments, groups of the adjustable orifices 58 (e.g., a group along a bottom end of the plates 50, 52 and/or along a middle or top end of the plates 50, 52) may be adjusted concurrently as a group relative to the other groups of orifices 58. The second plate 52 may include a plurality of separately adjustable plates that move relative to the first plate 50 to control the functional opening size for each group of orifices 58. In some embodiments, a separate valve member is positioned at each of the orifices 58 to control fluid flow there through. The valves may be manually or automatically (e.g., electronically) controlled. In some embodiments, the size of the orifices 58 may be adjusted according to a preprogrammed control algorithm that is operated using a computing device.

The fasteners 60 of the plate assembly 16 may be adjusted to permit relative movement between the first and second plates 50, 52 or fixed relative to positioning of the first and second plates 50, 52. In some embodiments, the fasteners 60 may be used to connect the plate assembly 16 to the tank 12.

The weir 20 may include a plurality of flow channels 70, a plurality of mounting slots 72, and fasteners 74 as shown in at least FIGS. 2 and 3. The fasteners 74 may be used to connect the weir 20 to the plate assembly 16. The mounting slots 72 may permit some vertical adjustment of the weir 20 relative to the plate assembly 16. Adjusting the height of the weir 20 relative to the plate assembly 16 may adjust, at least in part, the amount of fluid flow that passes over the weir 20 into the rear chamber 39. The height of the weir 20 may also control the overall depth D of the processing solution 24 held in the tank 12 (see FIG. 6). Typically, the depth D is great enough to insure that all of the outlet openings 46 of the sparger box 14 are completely submerged when the rack 22 with substrates 84 are submerged in the bath of processing solution 24 (see FIG. 16). In some embodiments, the depth D may be great enough that the entire sparger box 14 is submerged, or at least all of the sparger box 14 except for the inlet opening 40 is submerged.

The flow channels 70 are positioned or defined between a plurality of protrusions 76 (see FIGS. 1 and 2). the protrusions 76 may have the same size and shape, and be equally spaced apart from each other thereby defining consistent shaped flow channels 70 along the length the weir 20. The flow channels 70 may be sized and shaped to provide increased flow as the depth D of processing solution 24 is increased relative to a particular position of the weir 20. The amount of processing fluid that passes through the flow channels 70 (e.g., over the top of weir 20) may be a certain percentage of the total amount of processing solution 24 that passes out of the outlet opening 36 of tank 12. In one example, the percentage flow through flow channels 70 is in the range of about of 0% to about 25%, and more particularly in the range of about 0% to about 5% of the total outflow through outlet opening 36. In arrangements in which the orifices 58 are closed, 100% of the total outflow may pass over the weir 20.

The rack 22 may include a plurality of mounting supports 80 and substrates supports 82, and be configured to hold a plurality of substrates 84, as shown in at least FIGS. 1-4. The mounting supports 80 may engage with the carriage supports 38 of the tank 12, as shown in at least FIG. 2. The substrates supports 82 may support a plurality of substrates 84. Typically, the rack 22 is sized and arranged such that all of the substrates 84 are positioned within the tank 12 and exposed to the flow of processing solution 24, as shown in at least FIGS. 6 and 7. More particularly, the substrates 84 are intended to be exposed to the horizontal flow 29 of processing solution 24 that passes out from the sparger box 14 and into the orifices 58 in plate assembly 16 and/or over the weir 20, as shown in FIGS. 6 and 7.

Figure 6:
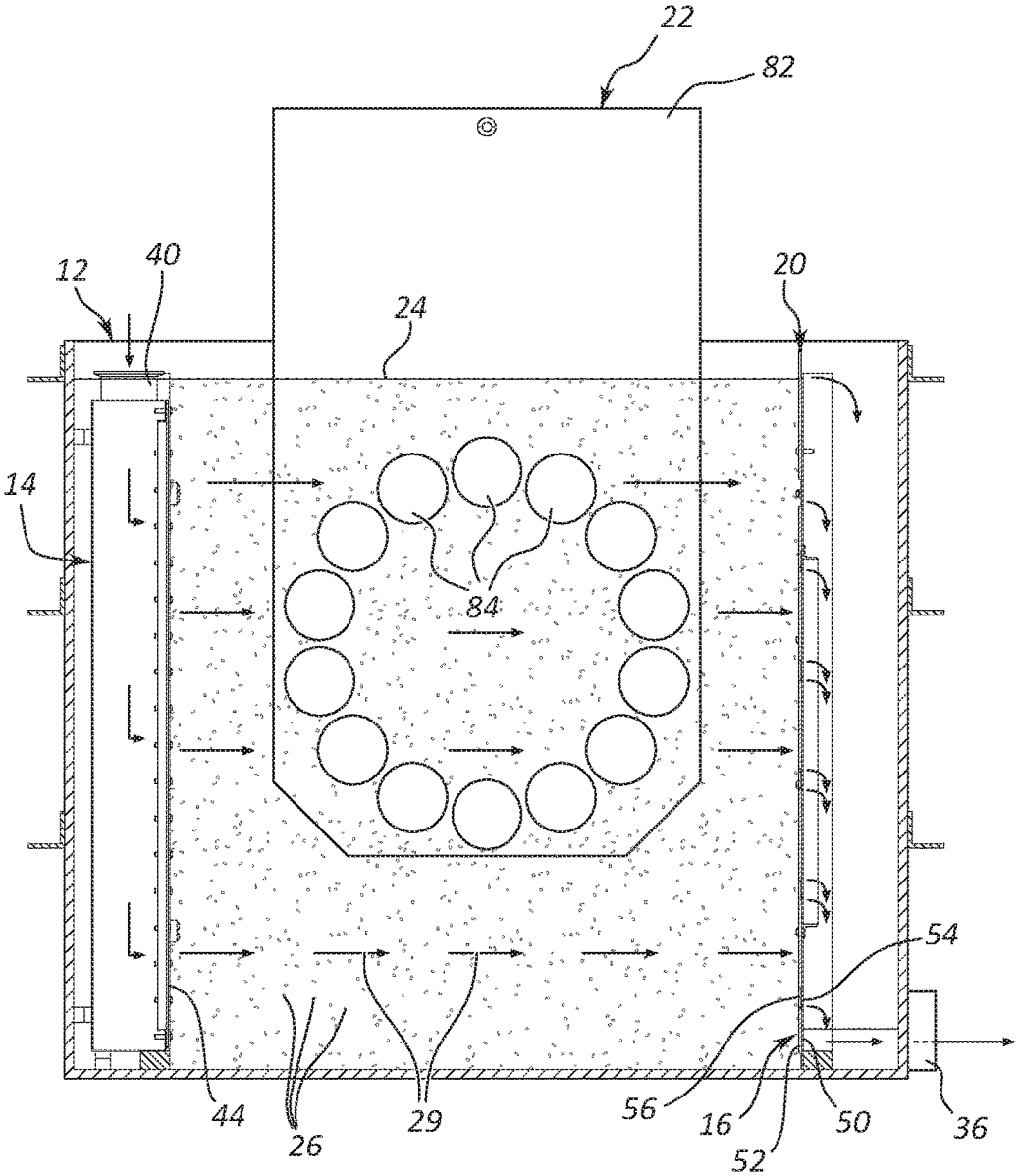
FIG. 6 is shows the cross-sectional view of FIG. 5 in a first flow arrangement.
Figure 7:
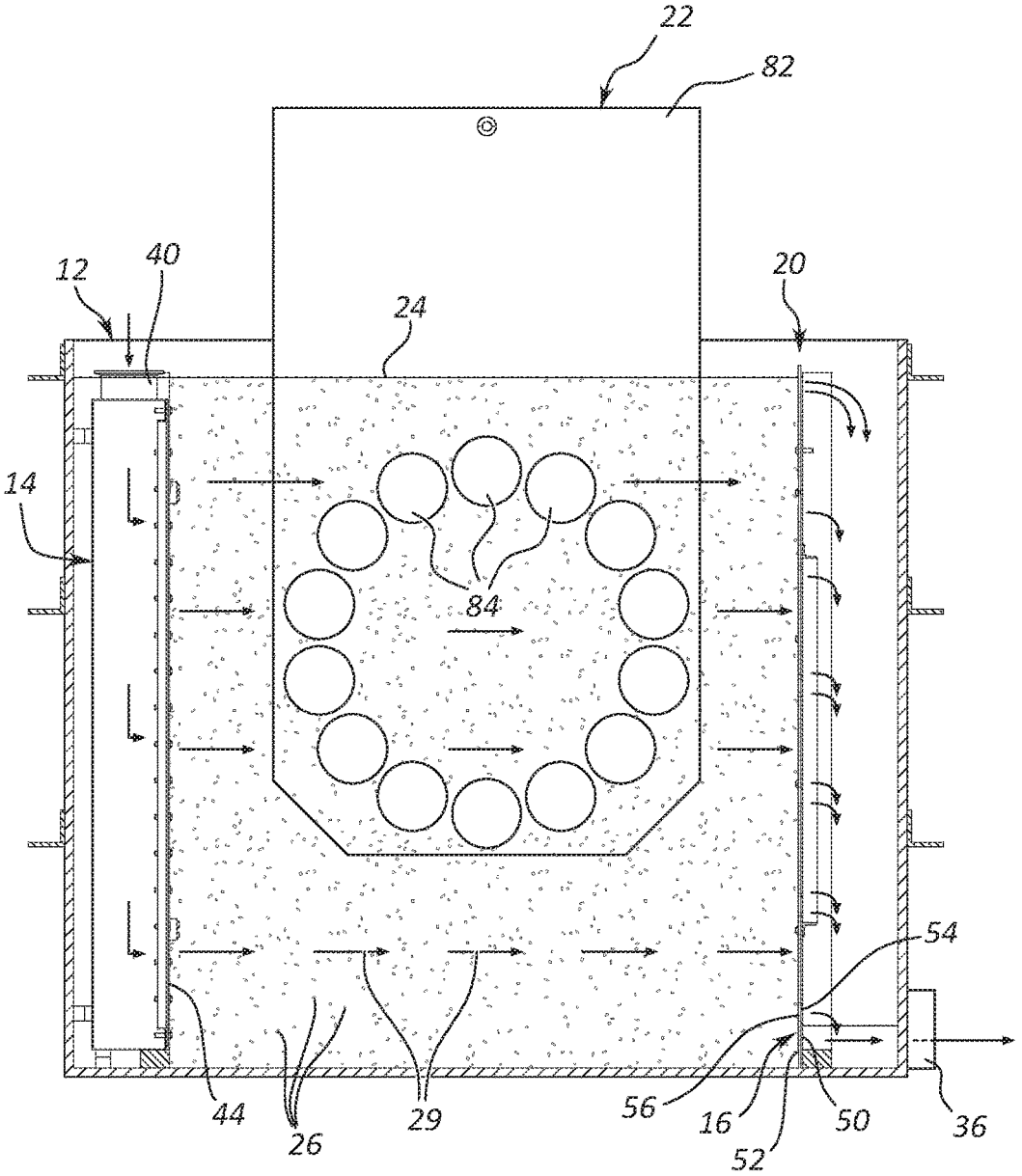
FIG. 7 shows the cross-sectional view of FIG. 5 in a second flow arrangement.
Figure 8:
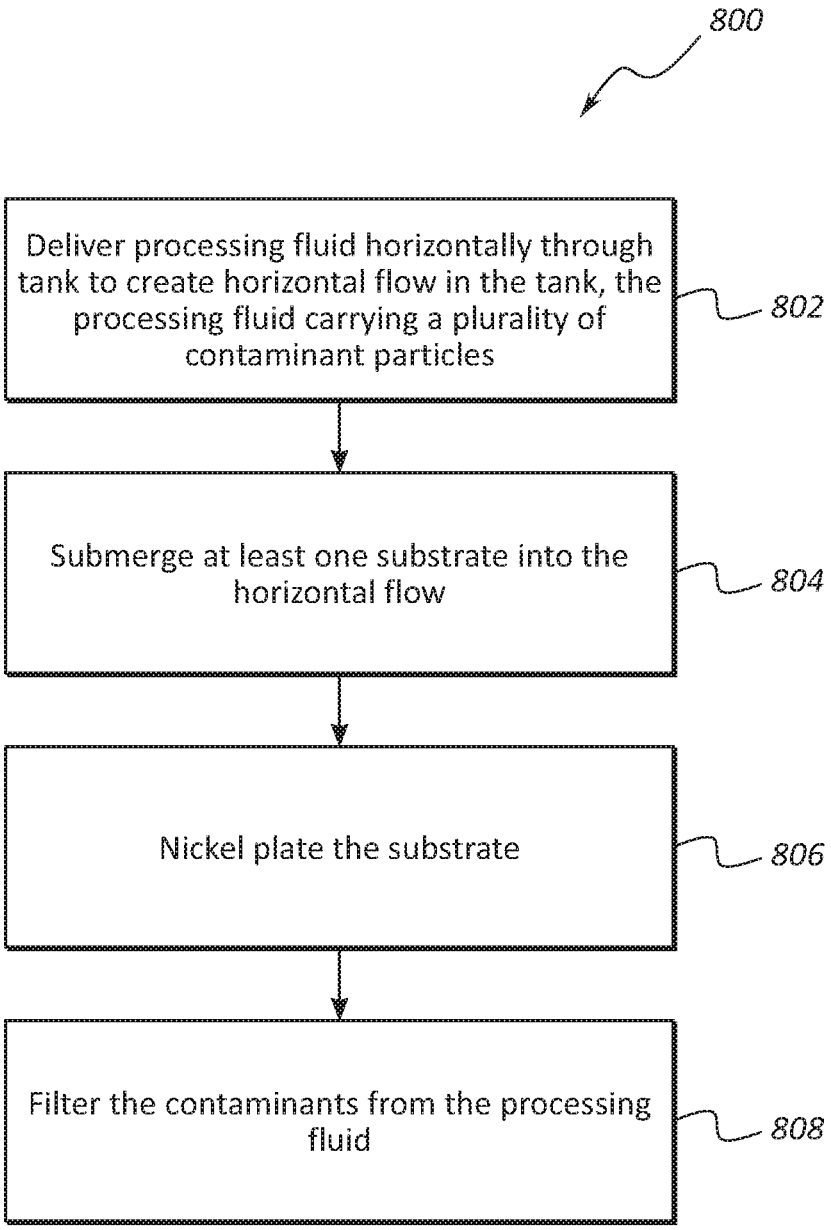
FIG. 8 is a flow diagram illustrating an example method in accordance with the present disclosure.

Referring now to FIGS. 6 and 7, the portions of plating system 10 are shown in cross-sectional view with the tank 12 filled with processing solution 24 and a plurality of contaminants or contaminant particles 26 held in tank 12. FIG. 6 shows the second plate 52 at a lower position than what is shown in FIG. 7, which results in a smaller opening size for orifices 58.

A flow of processing solution 24 enters into the sparger box 14 through the inlet opening 40. The flow of processing solution 24 passes through the chamber 42 and out through the outlet openings 46 to create a horizontal flow 29 within the tank interior 30. The rack 22 and associated substrates 84, when submerged in the plating bath held in the tank interior, is exposed to the horizontal flow. The solution bath may be defined as the volume of solution retained in the tank 12 between the sparger box 14 and the plate assembly 16. The plating bath is shown in FIGS. 6 and 7 have a depth D.

As the horizontal flow 29 passes through the plating bath, the contaminants 26 are picked up and/or carried by the horizontal flow towards the orifices 58 in the plate assembly 16. As the processing solution 24 passes through the orifices 58, the contaminants 26 are carried out of the plating bath and collect in the rear chamber 39. Depending on the depth D of the bath and processing solution 24, at least some of the processing solution, with any contaminants carried therein, may pass over the weir 20 and into the rear chamber 39. The processing fluid and contaminants collected in rear chamber 39 then pass out of the outlet opening 36 of tank 12.

The processing solution with contaminants may be directed to filter 18, as shown in FIG. 1, or to another location for treatment. The filtered processing solution may be directed back into the inlet opening 40 of the sparger box 14 to provide a closed system for the plating system 10. In other embodiments, the processing solution 24 and contaminants 26 directed out of the outlet opening 36 may be processed in other ways besides being filtered and may not return directly to the sparger box 14.

The rate at which the processing solution flows into sparger box 14 and out of the sparger box 14 via the outlet opening 36 may vary depending on certain controls, variables, and settings for the plating system 10. For example, increasing a flow rate into the sparger box 14 at inlet opening 40 may provide increased pressure within sparger box 14 that provides increased flow rate through outlet openings 46 to create greater volume for the horizontal flow 29 through the plating bath and/or change flow characteristics of the horizontal flow 29. The outlet openings 46 may be increased or decreased in size, shape, or numbers of outlet openings to vary the flow rate, direction of flow, and location of flow of the processing solution 24 within the tank interior 30. The plate assembly 16 may be adjusted to provide different rates of flow through the orifices 58 and/or over the weir 20 to control the flow rate from the plating bath into the rear chamber 39. Further, the depth D of the processing solution 24 within the tank interior 30 may alter the rate of flow from the sparger box 14 into the plating bath and/or the outflow through plate assembly 16 due to changes in pressure at various locations in the tank interior 30.

In some embodiments, the sparger box 14 may include a greater number of outlet openings 46, a greater size for the outlet openings 46, or other characteristics that promote a the type of flow through the tank interior 30 (e.g., along the bottom end of the tank interior 30) that promotes maximum carrying of the contaminants out of the tank interior 30 and into the rear chamber 39. In other embodiments, the size, shape, and/or number of the outlet orifices 58 of the plate assembly 16 may be increased in certain areas to promote additional transport of contaminants out of the plating bath (e.g., along the bottom end of the tank interior 30). Generally, the plating system 10 may be designed to provide relatively consistent flow rates through the tank interior 30 at every location along the depth D to help achieve substantially laminar flow and/or substantially horizontal, consistent flow across the width of the tank 12 while the substrates 84 are exposed (submerged in) the processing solution 24 in the tank interior 30.

These and other features of the plating systems and methods disclosed herein may create a streamflow in an electroless nickel plating tank so as to enable contaminants in the plating bath to flow out from the tank more consistently and thoroughly thereby reducing the chance of resulting pits and sub-bumps resulting from the inclusion of contaminants in the processing solution to which the substrates are exposed.

The present systems and methods may also provide features and functionality that help control the inlet holes providing a flow of processing solution into the plating bath and or optimize the streamflow out of the plating bath (e.g., via plate assembly 16).

At least one advantage of the present disclosure is that the substrate that is being treated with an electroless deposited nickel coating may be free from plating inclusion, or at least substantially free from plating inclusion.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to explain the principles of the present systems and methods and their practical applications, to enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A nickel plating system, comprising:

a tank configured to hold a bath of processing solution and a plurality of contaminants, the tank configured to receive at least one substrate to receive nickel plating;

a flow device comprising a laminar sparger box, the laminar sparger box having a plurality of spaced apart walls that define an internal chamber, the laminar sparger box placed within the tank and connectably mounted to sidewalls of the tank, the flow device operable to provide horizontal flow of the processing solution within the bath across a length of the bath from the laminar sparger box to an opposite end of the bath, the processing solution carrying at least some of the plurality of contaminants;

a filter device in flow communication with an outlet from the tank and configured to remove the contaminants from the processing solution.

2. The system of claim 1, wherein the laminar sparger box is arranged vertically at one end of the tank and includes six walls.

3. The system of claim 2, wherein the laminar sparger box includes an inlet opening configured to receive a flow of the processing solution into the internal chamber, and a plurality of outlet openings oriented facing horizontally in the tank.

4. The system of claim 2, wherein the flow device includes a plate assembly oriented vertically in the tank and positioned at an opposite end of the tank from the sparger box, the plate assembly including a plurality of orifices.

5. The system of claim 4, wherein the plate assembly includes an adjustable plate and a fixed plate, the adjustable plate being movable relative to the fixed plate to adjust flow rate through the plurality of orifices.

6. The system of claim 4, wherein the plurality of orifices are adjustable-sized orifices.

7. The system of claim 4, further comprising a weir mounted to a top end of the plate assembly, the weir providing even flow of the processing solution over a top end of the plate assembly.

8. An electroless nickel plating system, comprising:

a tank configured to hold a bath of processing solution and a plurality of contaminant, the tank configured to receive at least one substrate to receive nickel plating;

a flow device comprising:

a laminar sparger box positioned within and connectably mounted to sidewalls of the tank at a first end of the tank, the laminar sparger box having a plurality of spaced apart walls that define an internal chamber, the laminar sparger box configured to deliver a flow of processing solution horizontally into the bath to create horizontal flow in the bath from one end of the bath to an opposite end of the bath, the plurality of contaminants being carried by the flow of processing solution;

a plate assembly positioned at a second end of the tank, the plate assembly comprising a plurality of orifices receptive of the flow of processing solution and plurality of contaminants.

9. The system of claim 8, wherein the plurality of orifices are arranged facing horizontally in the tank.

10. The system of claim 8, wherein the sparger box is oriented vertically at one end of the tank and the plate assembly is oriented vertically at an opposite end of the sparger box.

11. The system of claim 8, further comprising:

at least one filtering member arranged in flow communication with an outlet of the tank and operable to remove contaminants from the processing solution removed from the tank.

12. The system of claim 8, wherein the plate member comprises:

a first plate having the plurality of orifices formed therein; and a second plate that is movable relative to the first plate to control a functional opening size of the plurality of orifices.

13. The system of claim 8, further comprising a weir positioned mounted to the plate member at a location vertically above the plurality of orifices.

14. The system of claim 8, further comprising a carriage operable to move the at least one substrate into and out of the volume of processing fluid.

15. The system of claim 1, wherein the laminar sparger box is connectably mounted to vertical sidewalls of the tank.

* * * * *